US012595534B2

(12) United States Patent
Kalsar et al.

(10) Patent No.: US 12,595,534 B2
(45) Date of Patent: Apr. 7, 2026

(54) METAL MATRIX COMPOSITE MATERIAL AND METHOD

(71) Applicant: Battelle Memorial Institute, Richland, WA (US)

(72) Inventors: Rajib Kalsar, Richland, WA (US); Vineet V. Joshi, Richland, WA (US); Darrell R. Herling, Kennewick, WA (US); Xiaolong Ma, Kowloon (CN); Jens T. Darsell, Richland, WA (US); Benjamin J. Schuessler, Kennewick, WA (US); Curt A. Lavender, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 58 days.

(21) Appl. No.: 18/484,706

(22) Filed: Oct. 11, 2023

(65) Prior Publication Data

US 2024/0209476 A1 Jun. 27, 2024

Related U.S. Application Data

(60) Provisional application No. 63/414,986, filed on Oct. 11, 2022.

(51) Int. Cl.

| | |
|---|---|
| ***C22C 1/10*** | (2023.01) |
| ***B21C 23/04*** | (2006.01) |
| ***C22C 32/00*** | (2006.01) |

(52) U.S. Cl.

CPC ..... *C22C 1/10* (2013.01); *B21C 23/04* (2013.01); *C22C 32/0036* (2013.01)

(58) Field of Classification Search

None

See application file for complete search history.

(56) References Cited

U.S. PATENT DOCUMENTS

2017/0326690 A1* 11/2017 Heard ..... C22C 1/05
2023/0415267 A1* 12/2023 Sweeney ..... B33Y 10/00

OTHER PUBLICATIONS

Whalen et al., "High ductility aluminum alloy made from powder by friction extrusion", Feb. 20, 2019, Materialia, vol. 6, 100260. (Year: 2019).*

Zhang et al., "Thermodynamic analysis of the interface reaction and thermal stress of WCp/Fe composites", Jul. 3, 2020, Ceramics Int'l, vol. 46, pp. 26210-26215. (Year: 2020).*

"Friction Extrusion", Wikipedia, [Online]. Retrieved from the Internet: <https://en.wikipedia.org/wiki/Friction_extrusion> , 6 pages. Accessed on line Aug. 8, 2024.

Tang, W., "Production of wire via friction extrusion of aluminum alloy machining chips", Journal of Materials Processing Technology vol. 210 Issue 15, (Nov. 19, 2010), 7 pages.

* cited by examiner

*Primary Examiner* — Xiaobei Wang

(74) *Attorney, Agent, or Firm* — Schwegman, Lundberg & Woessner, P.A.

(57) ABSTRACT

A metal matrix composite material and associated methods are disclosed. In one example, the metal matrix composite material includes ceramic particles distributed in multiple phases. In selected examples, the metal matrix composite material is formed by a process including applying a rotational force and an axial force to a feedstock at an interface and plasticizing a portion of the feedstock at the interface.

8 Claims, 6 Drawing Sheets

METAL MATRIX COMPOSITE MATERIAL AND METHOD

CROSS-REFERENCE TO RELATED APPLICATIONS

This application claims priority from U.S. Provisional Application No. 63/414,986 filed on Oct. 11, 2022, the contents of which are herein incorporated by reference.

STATEMENT REGARDING RIGHTS TO INVENTION ARE UNDER FEDERALLY SPONSORED RESEARCH AND DEVELOPMENT

This invention was made with Government support under Contract DE-AC05-76RL01830 awarded by the U.S. Department of Energy. The Government has certain rights in the invention.

TECHNICAL FIELD

Embodiments described herein generally relate to composite materials and associate methods. Specific examples include metal matrix composite materials and associated methods.

BACKGROUND

The next-generation high performance structural materials are expected to be exceptionally high-strength and ductile. However, these two properties are exclusive in a uniform microstructure.

Aluminum metal matrix composites (Al-MMCs) are potential light weight candidates for automobiles and other structural applications because of their low density, high specific stiffness and superior wear resistance properties. Processes currently being applied for production of Al-MMC are (i) powder metallurgy, (ii) melting and casting, (iii) friction stir processing, (iv) accumulating roll bonding, etc. Several disadvantages are reported associated with conventional processing routes, such as particle agglomeration due to van der Waals force of attraction that causes non-uniform particle distribution and poor particle wettability at the interface between ceramic particles and metallic matrix. This can cause interface failure during tensile loading, which leads to poor ductility. Other major disadvantages with conventional MMC processing routes include, high energy consumption, time consuming processes, and difficulty scaling up the process.

It is desired to provide methods and associated materials that address these concerns, and other technical challenges.

DESCRIPTION OF EMBODIMENTS

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Figure 1A:
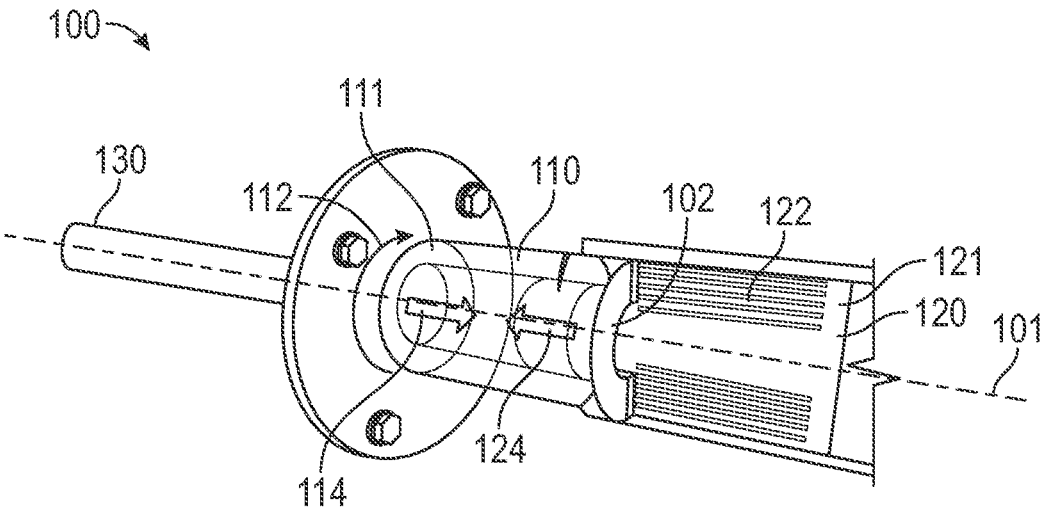
FIG. 1A shows a composite extrusion system in accordance with some example embodiments.

FIG. 1A shows a system 100 for forming a composite extrusion. The system 100 includes a die tool 110 and a feedstock 120. In operation, the system 100 is configured such that at an interface 102 between the die tool 110 and the feedstock 120, a rotational force 112 and an axial force 114 is applied. In response to the forces applied, a portion of the feedstock 120 is plasticized at the interface 102. The plasticized feedstock material is then displaced through the orifice 111 along a central axis 101 in direction 124.

In the example of FIG. 1A, the feedstock 120 is shown including a metal portion 121 and one or more regions 122. In one example, the one or more regions 122 are at least partially filled with the ceramic particles. Examples of ceramic particles include ceramic powder, ceramic fibers, or other geometries of particles that include ceramic. In one example, the ceramic particles include aluminum oxide particles. Although aluminum oxide is used as an example, other ceramic particles are also within the scope of the present disclosure. In one example, a size distribution of particles is on an order of 0.1 to 10's of micrometers, although the invention is not so limited. Other particle sizes and other particle size distributions are also within the scope of the invention.

In one example, the metal portion 121 includes aluminum, or an aluminum alloy. In one example, the metal portion 121 includes 6061 aluminum alloy. As discussed in more detail below, in one example, alloy elements from 6061 aluminum react during processing with the ceramic particles, and enhance the mechanical properties of a final product material. Although aluminum is used as an example metal portion 121, and ceramic particles are used as an example particle, the invention is not so limited. The processes described in the present disclosure can be applied to other metals or metal alloys, and other particulate phase particles.

Figure 1B:
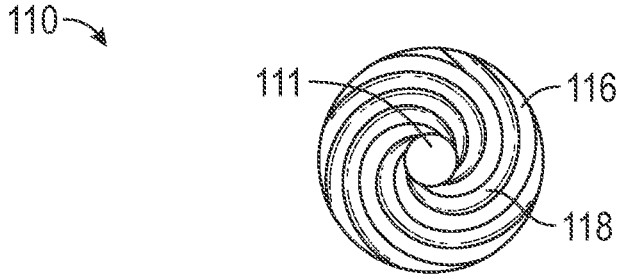
FIG. 1B shows selected components of a composite extrusion system in accordance with some example embodiments.

The die tool 110 includes an orifice 111 through which an extrudate 130 from the plasticized feedstock 120 is forced. As described in more detail below, in one example, the extrudate 130 includes a discrete first phase and a discrete second phase. FIG. 1B shows an end view of the die tool 110 from FIG. 1A. the orifice 111 is shown in a center of the die tool 110. In the example of FIG. 1B, a face 116 of the die tool 110 that forms one side of the interface 102 includes one or more channels 118. In one examples, the channels 118 facilitate movement of the plasticized feedstock material from the interface 102 into the orifice 111.

Figure 1C:
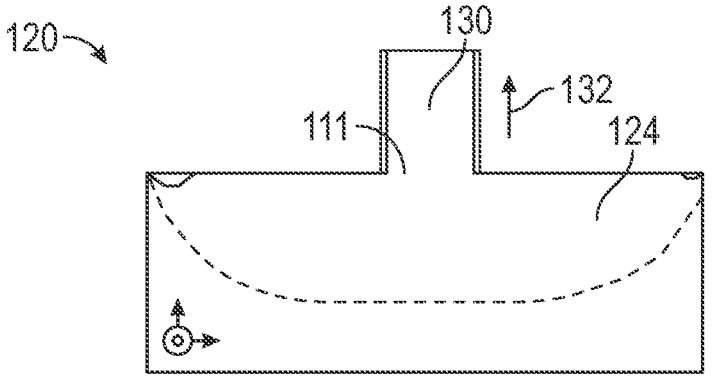
FIG. 1C shows selected components of a composite extrusion system in accordance with some example embodiments.

FIG. 1C shows a diagram of a cross section of one example of the feedstock 120. In one example, the feedstock 120 may also be referred to as a puck. In response to applied forces, including, but not limited to the rotational force 112 and an axial force 114, a region 126 of the feedstock 120 is plasticized from the energy generated at the interface 102. Feedstock material from the region 126 is channeled and/or forced into the orifice 111, and the extrudate 130 is formed. Arrow 132 indicates the direction of the extrudate in the example shown. As noted above, in one example, the feedstock 120 includes regions of both metal 121 and regions 122 at least partially filled with the ceramic particles. An arrangement of the metal 121 and the regions 122 formed using the system 100 described produces a unique microstructure in the extrudate 130. In one example, the extrudate 130 as formed includes multiple phases in a microstructure that produces unique mechanical properties in the extrudate 130. A two phase (bimodal) example is described, although the invention is not so limited. Multiple phases may be produced by different configurations within the feedstock 120 as described in more detail below.

In one example, a metal matrix composite is produced having a bimodal-grained microstructure including coarse metallic grains and fine metallic grains. The microstructure facilitates a strength-ductility synergy over the strength-ductility trade-off dilemma due to grain size reduction. Under external strain, the coarse grains provide ductility by accommodating dislocation movement, while the fine grains provide strength by impeding dislocation movement.

In addition to forces such as rotational force 112 and an axial force 114, other variables may also be controlled to adjust the microstructure of the extrudate 130. Other processing variables, include, but are not limited to, rotational velocity of the die tool, axial speed of the die tool, and temperature conditions at the interface 102. In one example, the interface 102 temperature is controlled by varying one or more of the variables above, or other variables. In one example, the interface 102 temperature is monitored and controlled within a temperature range of 350-450° C. External heating or external cooling such as resistive heating and/or cooling fluid may also be used to further control the interface 102 temperature.

Figure 2A:
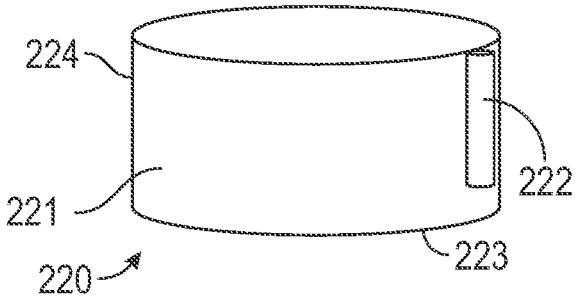
FIG. 2A shows selected components of a feedstock in accordance with some example embodiments.
Figure 2B:
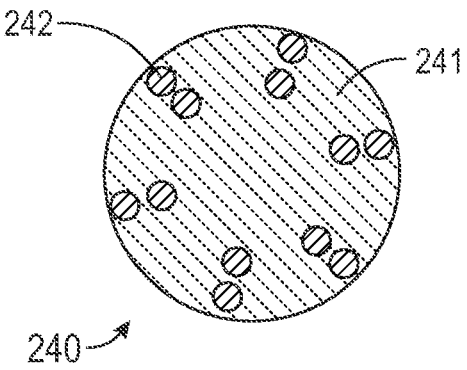
FIG. 2B shows selected components of another feedstock in accordance with some example embodiments.
Figure 2C:
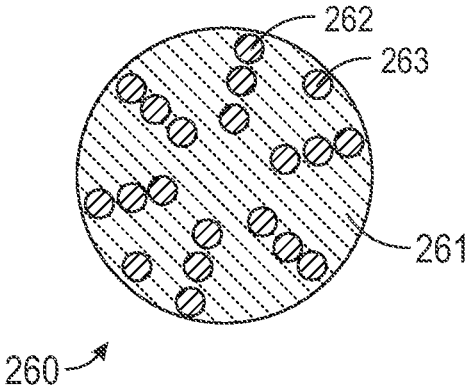
FIG. 2C shows selected components of another feedstock in accordance with some example embodiments.

FIGS. 2A-2C show selected examples of feedstock pucks similar to the feedstock 120 shown in FIGS. 1A-1C. In FIG. 2A, a feedstock puck 220 is shown, including a metal portion 221 and one or more regions 222 at least partially filled with the ceramic particles. In one example the region 222 includes a drilled hole, although other geometries are also within the scope of the invention, such as slots, wedges, etc. In the example, of FIG. 2A, the region 222 is static, and pre-loaded with ceramic particles. In other examples, regions 222 may be dynamically filled from an external hopper as the feedstock puck 220 is processed with the system 100. In one example, regions 222 may be open from a rear 223 of the feedstock puck 220 and fed during manufacture with the ceramic particles. In one example, the regions 222 may include radial slots exposed on sides 224 of the feedstock puck 220, and the regions 222 are fed during manufacture with the ceramic particles from a hopper on sides 224.

By choosing a configuration of the regions 222 in the puck 220, different microstructure phases are be created. FIG. 2B shows an example puck 240 that includes multiple regions 242 arranged radially within a metal 241 about the puck 240. In the example of FIG. 2B, the regions 242 are uniformly positioned radially about the puck 240. A larger number of regions provides a higher percentage of ceramic particles in a resulting extrudate. FIG. 2C shows a puck 260 including a larger number of regions 262 within a metal 261. The example of FIG. 2C further shows a configuration where the regions 262 are not completely uniformly positioned radially about the puck 260. Regions 263 are added in addition to the regions 262, breaking at least some level of symmetry. As noted above, different arrangements of the regions result in different microstructures, that in turn provide unique mechanical properties in a resulting extrudate. In one example, the ceramic particles are between 5% and 20% volume percent of the feedstock.

Figure 3:
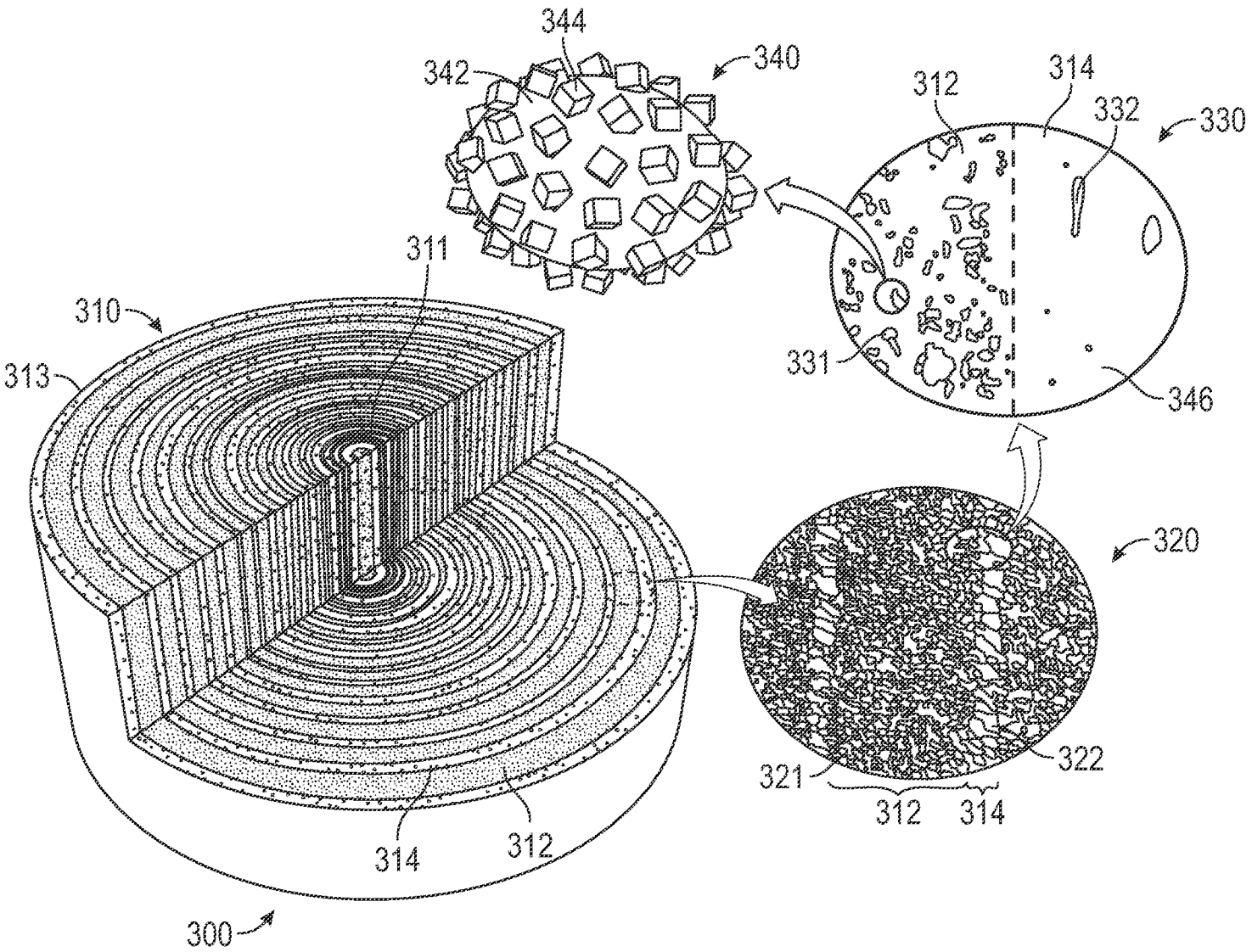
FIG. 3 shows details of a microstructure of a metal matrix composite (MMC) in accordance with some example embodiments.

FIG. 3 shows details of selected examples of a microstructure 300 of a metal matrix composite manufactured using methods described. An extrudate 310 is shown having a center 311 and a periphery 313. The extrudate 310 illustrated is a solid rod, although the invention is not so limited. Other extruded configurations, such as a seamless tube formed over a mandrel are also possible. Additionally, other extruded cross sections apart from circular are within the scope of the invention, for example, square, T-shaped, etc.

FIG. 3 shows a first phase 312 and a second phase 314 arranged in a pattern. In the example shown, the first phase 312 and the second phase 314 are arranged in respective regions aligned concentrically in an alternating manner. Although a particular pattern is illustrated in FIG. 3, other patterns of phases 312, 314, and also additional phases, are included in the present disclosure, and may be formed by varying a pattern of regions within a feedstock as described in FIGS. 2A-C.

In one example, the first phase 312 is particle rich relative to the second phase 314. In one example, the first phase 312 includes a finer particle size distribution of particles relative to the second phase 314. In one example, the method of manufacture as described in examples above, produces the unique microstructure including phases 312 and 314.

Figure 4:
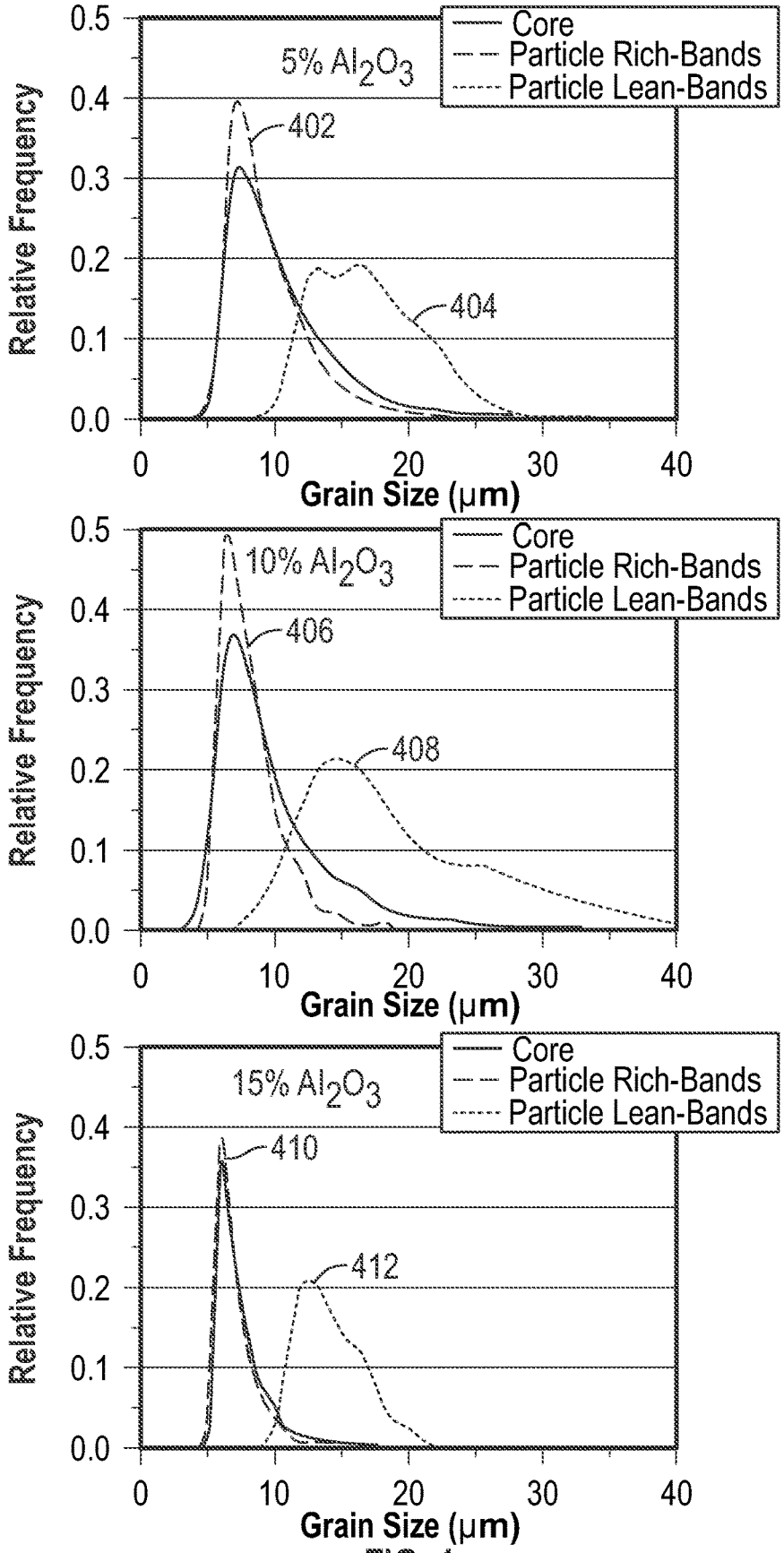
FIG. 4 shows grain size distributions of selected phases in a metal matrix composite (MMC) in accordance with some example embodiments.

A magnified cross section 320 shows that the first phase 312 includes a smaller average metallic grain 321 size, and the second phase 314 includes a larger average metallic grain 322 size relative to the first phase 312. In one example the larger average metallic grain size provides a greater ductility than the smaller average metallic grain size. Sizes of metallic grains between phases can be characterized in multiple ways. For example, average grain size can be different between the first phase 312 and the second phase. In addition, grain size distribution can be tighter or wider within each of the first phase 312 and the second phase 314. FIG. 4 illustrates differences in grain size distribution as well as average grain size.

Magnified cross section 330 shows a micrograph of the first phase 312 and the second phase 314. The first phase 312 includes a high concentration of ceramic particles 331. In comparison, the second phase 314 includes relatively few ceramic particles 332 compared to the first phase 312. Fewer particles results in greater ductility due to the ability of dislocations to move with less restriction from particles 332. More particles 331 results in higher strength due to the higher likelihood of pinning of dislocations from particles 331. As a result of the combination of phases 312, 314, the extrudate 310 exhibits both high strength and high ductility.

A diagram of an individual ceramic particle 340 is further shown in FIG. 3. The particle 340 includes a base ceramic particle 342 and a plurality of nanostructures 344 on an interface between the base ceramic particle 342 and the bulk material 346 (for example, aluminum). In one example, the plurality of nanostructures 344 include magnesium aluminum oxide. In one example, nanostructures 344 are formed by a reaction between the base ceramic particle 342 and magnesium from a 6061 aluminum alloy bulk material 346. In one example, the plurality of nanostructures 344 include a spinel structure, although the invention is not so limited. The presence of the plurality of nanostructures 344 further enhances dislocation pinning on each ceramic particle 340, and further enhances strength provided by the second phase 314.

FIG. 4 shows measured metallic grain size distribution differences between the first phase 312 and the second phase 314 as shown in FIG. 3. In a 5% by volume of aluminum oxide in an aluminum matrix, the first phase 312 shows a grain size distribution 402 that is smaller than a grain size distribution 404 of the second phase 314. In a 10% by volume of aluminum oxide in an aluminum matrix, the first phase 312 shows a grain size distribution 406 that is smaller than a grain size distribution 408 of the second phase 314. In a 15% by volume of aluminum oxide in an aluminum matrix, the first phase 312 shows a grain size distribution 410 that is smaller than a grain size distribution 412 of the second phase 314. An average grain size can also be calculated within each of the separate peaks. The three plots shown in FIG. 4 indicate some degree of overlap between grain size distributions in the first phase 312 and second phase 314. Other statistical figures of merit such as a median and an average grain size within the first phase 312 and the second phase 314 are distinguishably different.

Figure 5A:
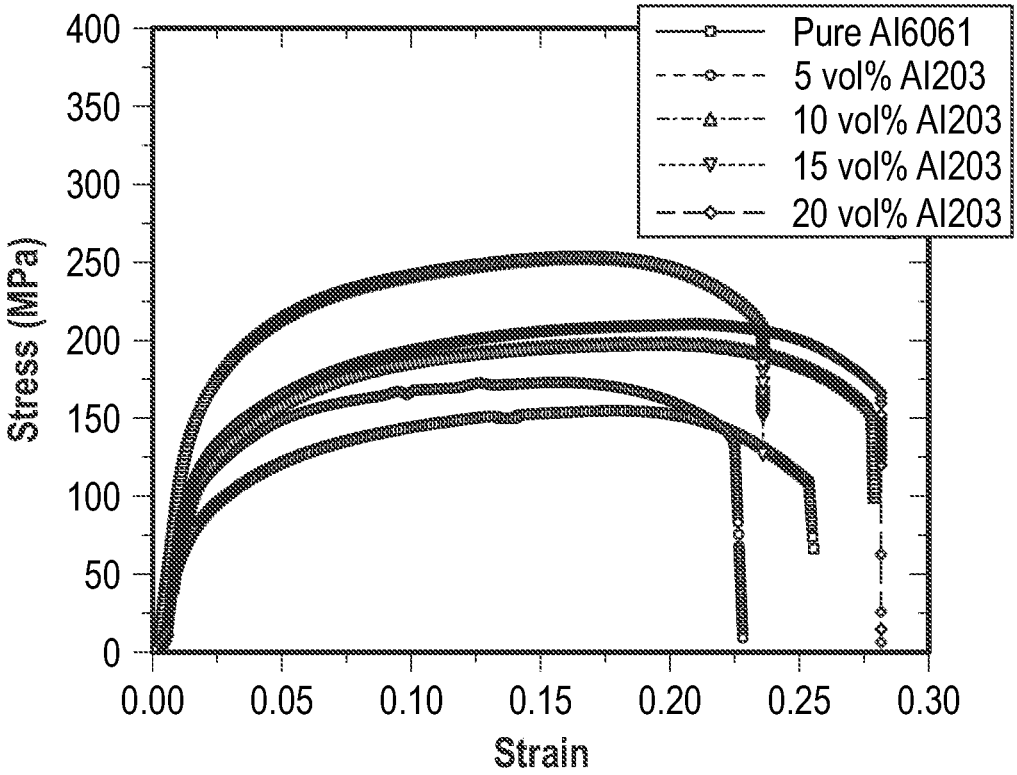
FIG. 5A shows stress strain curves of selected materials in accordance with some example embodiments.

FIG. 5A shows a number of stress-strain curves for example metal matrix composite materials of varying compositions formed by methods described. Samples shown in the plot include no aluminum oxide particles, 5% by volume aluminum oxide particles, 10% by volume aluminum oxide particles, 15% by volume aluminum oxide particles, and 20% by volume aluminum oxide particles. In FIG. 5A, ductile strain achieved before fracture is greater than 0.20 for all composition variations. This illustrates the ability of the microstructures described to provide high ductility while also including various percentages of ceramic particles in a composite.

Figure 5B:
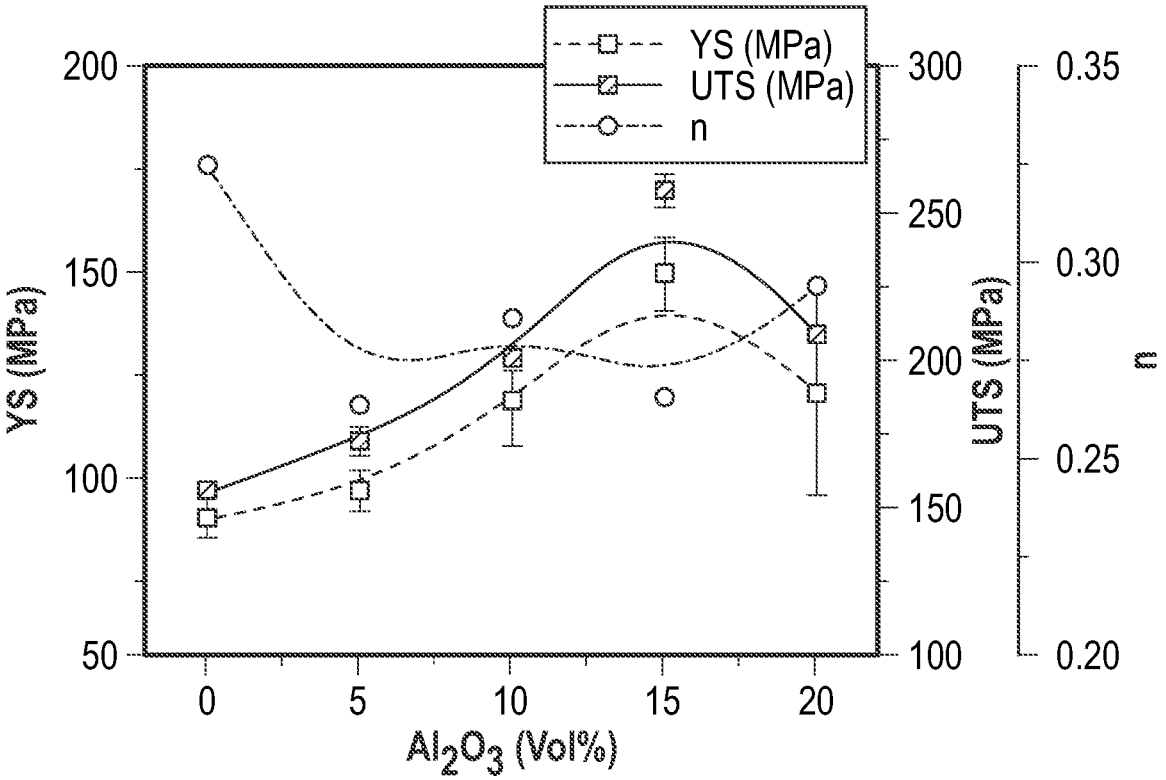
FIG. 5B shows yield stress versus distributed phase of selected materials in accordance with some example embodiments.

FIG. 5B shows a number of plots of yield stress (YS), ultimate tensile stress (UTS), and strain hardening exponent (n) for similar composition samples from FIG. 5A. The data shown in FIG. 5B shows that the addition of ceramic particles in the metal matrix composite materials described provides improved mechanical properties such as strength and toughness, while the data from FIG. 5A shows that ductility is preserved.

Figure 6:
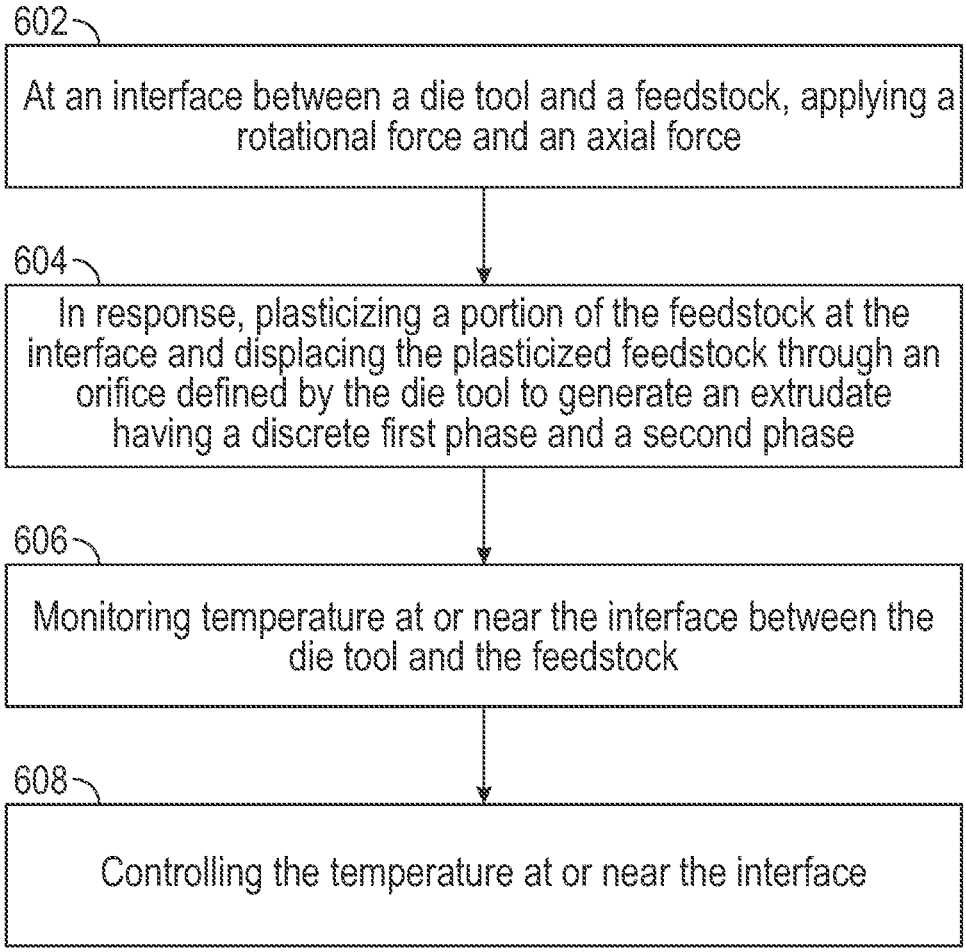
FIG. 6 shows a flow diagram of a method of manufacture in accordance with some example embodiments.

FIG. 6 shows a flow chart of one example method of manufacture. In operation 602, at an interface between a die tool and a feedstock, a rotational force and an axial force are applied. In operation 604, in response, a portion of the feedstock is plasticized at the interface and the plasticized feedstock is displaced through an orifice defined by the die tool to generate an extrudate having a discrete first phase and a second phase. In selected examples, operation 606 shows monitoring temperature at or near the interface between the die tool and the feedstock. In operation 608, the temperature at or near the interface is controlled. Examples of control variables include, but are not limited to controlling one or more of rotational velocity in rotations per minute (RPM), axial force, rotational force (torque), and a rate of axial speed. In one example, controlling temperature also includes applying heat or cooling with an external heater or a cooling medium.

To better illustrate the method and apparatuses disclosed herein, a non-limiting list of embodiments is provided here:

Example 1. A friction extrusion method for forming a composite extrusion, the method comprising: at an interface between a die tool and a feedstock, applying a rotational force and an axial force; and in response, plasticizing a portion of the feedstock at the interface and displacing the plasticized feedstock through an orifice defined by the die tool to generate an extrudate having a discrete first phase and a second phase; wherein the feedstock comprises a metal portion and ceramic particles, the metal portion defining one or more regions, the one or more regions at least partially filled with the ceramic particles: wherein the first phase and the second phase are defined by different distributions of the ceramic particles in the metal portion.

Example 2. The method of example 1, wherein the ceramic particles include powder particles.

Example 3. The method of example 1, wherein the extrudate includes a solid cross section rod.

Example 4. The method of example 1, wherein the extrudate defines a cross-section having respective regions comprising the first phase and the second phase in a pattern to improve ductility.

Example 5. The method of example 1 further comprising: monitoring temperature at or near the interface between the die tool and the feedstock: and controlling the temperature at or near the interface by adjusting one or more of a rotational velocity in rotations per minute (RPM), the axial force, the rotational force (torque), and a rate of axial speed.

Example 6. The method of example 5, wherein adjusting the axial force and adjusting the rotational force occurs within a temperature range of 350-450° C.

Example 7. The method of example 1, wherein the one or more regions are uniformly positioned about the feedstock.

Example 8. The method of example 1, wherein the metal portion is aluminum and the ceramic particles incudes an aluminum oxide ceramic powder, and wherein the extrudate is an aluminum metal matrix composite.

Example 9. The method of example 1, wherein the ceramic particles are between 5% and 20% volume percent of the feedstock.

Example 10. A metal matrix composite (MMC) friction extrudate comprising: a first phase: a second phase: and wherein the first phase and the second phase occur in respective regions aligned concentrically in an alternating manner.

Example 11. The MMC friction extrudate of example 10, wherein the first phase and the second phase include ceramic particles, and wherein the first phase is lean in ceramic particles, and the second phase is rich in ceramic particles relative to the first phase.

Example 12. The MMC friction extrudate of example 10, further comprising: a bulk material: particles dispersed in the bulk material; and wherein the first phase and the second phase include the particles disposed in the bulk material in different concentrations, and wherein the first phase has a first metallic grain size distribution and the second phase has a second metallic grain size distribution that is smaller relative to the first phase.

Example 13. The MMC friction extrudate of example 12, wherein the particles include ceramic particles.

Example 14. The MMC friction extrudate of example 13, wherein an individual particle of the particles further includes a plurality of nanostructures on an interface between the individual particle and the bulk material.

Example 15. The MMC friction extrudate of example 14, wherein the plurality of nanostructures include a spinel material.

Example 16. The MMC friction extrudate of example 12, wherein the particles have radii on an order of 0.1 to 10's of micrometers.

Example 17. The MMC friction extrudate of example 10, wherein the MMC friction extrudate has a yield strength of at least 100 MPa with a uniform elongation of at least 10%.

Example 18. A metal matrix composite (MMC) friction extrudate comprising: a bulk material comprising: particles dispersed in the bulk material, an individual particle of the particles comprising a plurality of nanostructures on an interface between the individual particle and the bulk material: wherein a first phase and a second phase includes the particles disposed in the bulk material in different concentrations, and wherein the first phase is particle rich relative to the second phase: and wherein the first phase and the second phase occur in respective regions aligned concentrically in an alternating manner.

Example 19. The MMC friction extrudate of example 18, wherein the bulk material includes aluminum, the particles include aluminum oxide, and the nanostructures include magnesium aluminum oxide.

Example 20. The MMC friction extrudate of example 18, wherein the particles have radii on an order of 0.1 to 10's of micrometers.

Example 21. The MMC friction extrudate of example 18, wherein the first phase has a first grain size distribution and the second phase has a second grain size distribution that is smaller relative to the first phase.

Example 22. The MMC friction extrudate of example 18, wherein the MMC friction extrudate has a yield strength of at least 100 MPa with a uniform elongation of at least 10%.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the inventive subject matter has been described with reference to specific example embodiments, various modifications and changes may be made to these embodiments without departing from the broader scope of embodiments of the present disclosure. Such embodiments of the inventive subject matter may be referred to herein, individually or collectively, by the term "invention" merely for convenience and without intending to voluntarily limit the scope of this application to any single disclosure or inventive concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

As used herein, the term "or" may be construed in either an inclusive or exclusive sense. Moreover, plural instances may be provided for resources, operations, or structures described herein as a single instance. Additionally, boundaries between various resources, operations, modules, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

The foregoing description, for the purpose of explanation, has been described with reference to specific example embodiments. However, the illustrative discussions above are not intended to be exhaustive or to limit the possible example embodiments to the precise forms disclosed. Many modifications and variations are possible in view of the above teachings. The example embodiments were chosen and described in order to best explain the principles involved and their practical applications, to thereby enable others skilled in the art to best utilize the various example embodiments with various modifications as are suited to the particular use contemplated.

It will also be understood that, although the terms "first," "second," and so forth may be used herein to describe various elements, these elements should not be limited by these terms. These terms are only used to distinguish one element from another. For example, a first contact could be termed a second contact, and, similarly, a second contact could be termed a first contact, without departing from the scope of the present example embodiments. The first contact and the second contact are both contacts, but they are not the same contact.

The terminology used in the description of the example embodiments herein is for the purpose of describing particular example embodiments only and is not intended to be limiting. As used in the description of the example embodiments and the appended examples, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting

[the stated condition or event]" or "in response to detecting [the stated condition or event]," depending on the context.

The invention claimed is:

1. A metal matrix composite (MMC) friction extrudate comprising:

a metal matrix, the metal matrix including;

a first phase;

a second phase different from the first phase; and wherein the metal matrix is continuous through the first phase and wherein the metal matrix is also continuous through the second phase;

wherein the first phase and the second phase occur in respective regions aligned concentrically in an alternating manner.

2. The MMC friction extrudate of claim 1, wherein the first phase and the second phase include ceramic particles, and wherein the first phase is lean in ceramic particles, and the second phase is rich in ceramic particles relative to the first phase.

3. The MMC friction extrudate of claim 1, further comprising:

particles dispersed in the metal matrix; and wherein the particles are disposed in the metal matrix in different concentrations, and wherein a portion of the metal matrix in the first phase has a first metallic grain size distribution and a portion of the metal matrix in the second phase has a second metallic grain size distribution that is smaller relative to the first phase.

4. The MMC friction extrudate of claim 3, wherein the particles include ceramic particles.

5. The MMC friction extrudate of claim 4, wherein an individual particle of the particles further includes a plurality of nanostructures on an interface between the individual particle and the metal matrix.

6. The MMC friction extrudate of claim 5, wherein the plurality of nanostructures include a spinel material.

7. The MMC friction extrudate of claim 3, wherein the particles have radii on an order of 0.1 to 10's of micrometers.

8. The MMC friction extrudate of claim 1, wherein the MMC friction extrudate has a yield strength of at least 100 MPa with a uniform elongation of at least 10%.

* * * * *